US005900263A

United States Patent [19]

Gics

[11] Patent Number: 5,900,263

[45] Date of Patent: May 4, 1999

[54] FOOD PACKAGE HAVING A RIGID LEG MEMBER FOR DISPLAYING THE FRONT PANEL THEREOF

[75] Inventor: Paul W. Gics, Sewickley Heights, Pa.

[73] Assignee: GICS & Vermee, L.P., Sewickley, Pa.

[21] Appl. No.: 09/067,996

[22] Filed: Apr. 28, 1998

Related U.S. Application Data

[62] Division of application No. 08/883,062, Jun. 26, 1997, abandoned.

[51] Int. Cl.[6] ..... A22C 17/10; A21D 10/02

[52] U.S. Cl. ..... 426/87; 426/108; 426/110; 426/119; 426/122; 206/459.5; 220/902

[58] Field of Search ..... 426/87, 108, 110, 426/119, 122; 206/459.5; 220/902

[56] References Cited

U.S. PATENT DOCUMENTS

| | | | |
|---|---|---|---|
| 3,126,660 | 3/1964 | Meyers . | |
| 3,412,889 | 11/1968 | Eicholtz et al. . | |
| 3,904,104 | 9/1975 | Kane . | |
| 4,653,685 | 3/1987 | Leary et al. | 229/2.5 R |
| 4,784,268 | 11/1988 | Perchak | 206/461 |
| 4,930,627 | 6/1990 | Borst et al. | 206/45.23 |
| 4,939,332 | 7/1990 | Hahn . | |
| 5,011,006 | 4/1991 | Anderson . | |
| 5,032,213 | 7/1991 | Thomas, Jr. . | |
| 5,090,615 | 2/1992 | Hopkins et al. . | |
| 5,119,940 | 6/1992 | Grindrod . | |
| 5,123,527 | 6/1992 | Hustad | 206/45.31 |
| 5,197,657 | 3/1993 | Cassidy et al. . | |
| 5,234,159 | 8/1993 | Lorence et al. . | |
| 5,326,575 | 7/1994 | Spaulding . | |
| 5,356,649 | 10/1994 | LaMotta et al. . | |
| 5,370,883 | 12/1994 | Saunier . | |
| 5,429,833 | 7/1995 | Wyslotsky | 426/122 |
| 5,492,703 | 2/1996 | Gics . | |
| 5,503,856 | 4/1996 | Hustad et al. | 426/108 |
| 5,695,798 | 12/1997 | Rozzano | 426/115 |
| 5,743,402 | 4/1998 | Gics | 206/45.5 |

FOREIGN PATENT DOCUMENTS

| | | |
|---|---|---|
| 0399981 | 11/1990 | European Pat. Off. . |
| 0492052 | 7/1992 | European Pat. Off. . |
| WO 8604880 | 8/1986 | WIPO . |

*Primary Examiner*—Nina Bhat
*Attorney, Agent, or Firm*—David V. Radack; Eckert Seamans Cherin & Mellott, LLC

[57] ABSTRACT

A food package including a tray, a sleeve surrounding the tray and a rigid leg member extending from the back panel of the sleeve. The rigid leg member has a bottom edge that can rest on a support surface in order to position the front panel of the sleeve substantially perpendicularly to the support surfaces. In this way, the display surface can be better seen by potential consumers. A multipack food package is also disclosed.

23 Claims, 10 Drawing Sheets

FOOD PACKAGE HAVING A RIGID LEG MEMBER FOR DISPLAYING THE FRONT PANEL THEREOF

This application is a divisional of Ser. No. 08/883,062 filed Jun. 26, 1997, now abandoned.

BACKGROUND OF THE INVENTION

This invention relates to a food package having a rigid leg member for displaying the front panel thereof.

Food packages, along with their obvious utilitarian purpose of allowing the food product therein to be shipped, must also "sell" the food product in the supermarket by providing attractive "facings" which are exposed to the potential consumer. Many irregular shaped packages, however, do not provide a proper facing. For example, an oblong or circular food package may not "stand up" and thus the supermarket customer cannot see the front panel of the food package which contains the graphics.

U.S. Pat. Nos. 5,090,615 and 5,234,159 provide a container/lid assembly which permits display of the front panel of the food package. However, there is not provided a sleeve which substantially surrounds the tray. This shortcoming limits the amount of facing surface available and so required labeling information (i.e., nutrition facts) must be placed on the front panel, thus detracting from the overall look of the front panel.

Commonly owned U.S. patent application Ser. No. 08/819,889, filed Mar. 18, 1997, discloses a food package including a tray and a sleeve. This food package, while providing an attractive facing, does not include means for allowing the package to "stand up" on a supermarket shelf.

What is needed, therefore, is a food package which provides an attractive facing that can be easily seen by supermarket shoppers.

SUMMARY OF THE INVENTION

The food package of the invention has met or exceeded the above-mentioned needs as well as others. The food package comprises a tray including a base and a sidewall extending from the base and terminating in a free edge. The free edge of the tray defines a tray opening. The food package further comprises a sleeve surrounding the tray, the sleeve including a front panel having a display surface, the front panel being adjacent the tray opening and a back panel adjacent to the base. A rigid leg member is provided that extends from the back panel. The rigid leg member has a bottom edge that can rest on a support surface in order to position the front panel substantially perpendicularly to the support surface. In this way, the display surface can be better seen by potential consumers.

A multipack food package is also provided wherein a plurality of trays are contained in one sleeve having a rigid leg member as was described above. The multipack food package has means for permitting separation of portions thereof so that one or more trays can be accessed by the consumer without disturbing the remaining trays.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
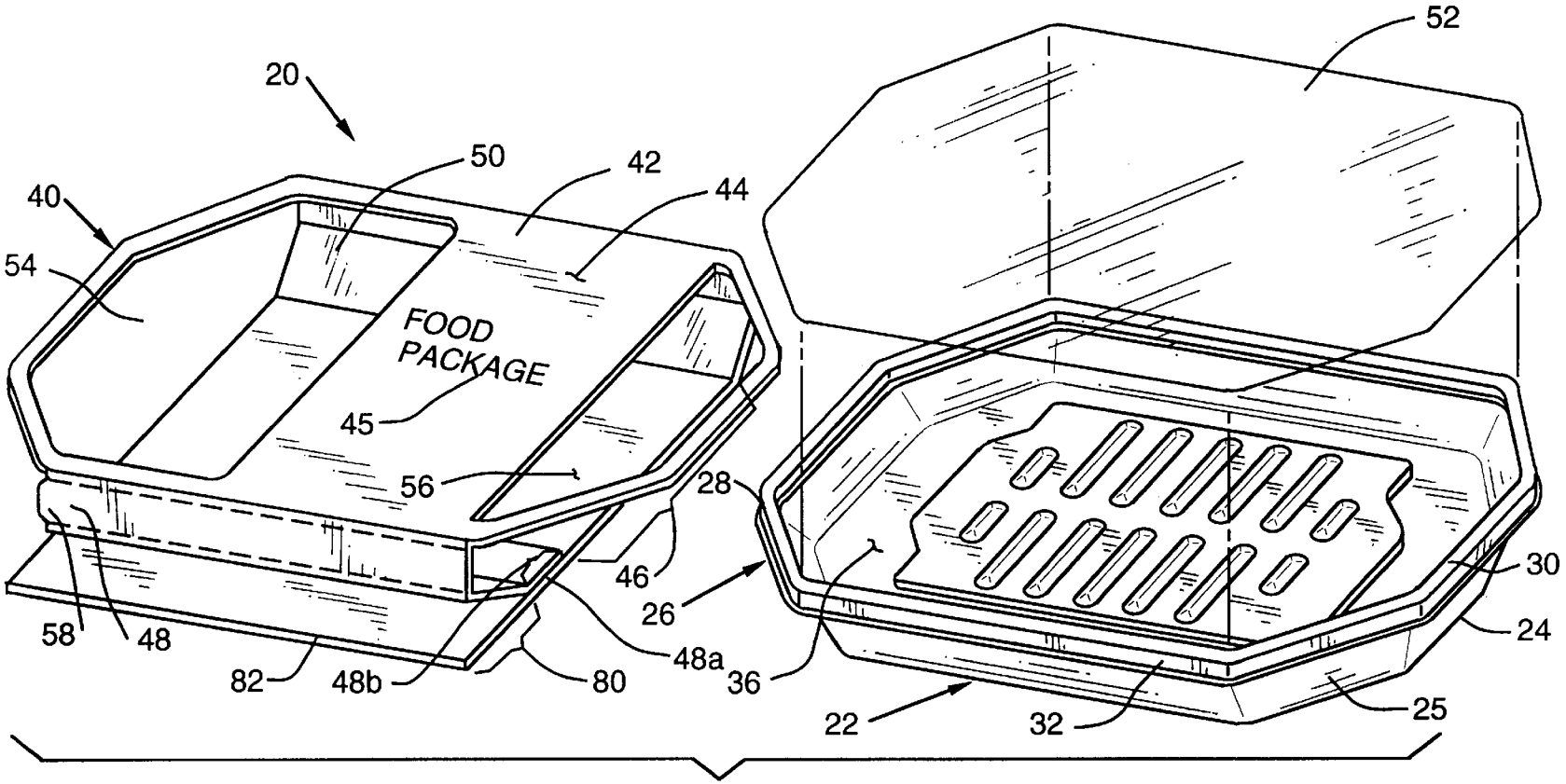
FIG. 1 is an exploded perspective of one embodiment of the food package.

Referring now to FIGS. 1–9, an embodiment of a food package in accordance with the invention will be discussed. The food package 20 consists of a tray 22 including a base 24 and a sidewall 25 extending from the base 24. The sidewall 25 terminates in a free edge 26, and, as shown in FIG. 1, the free edge 26 consists of a flange 28 having a horizontal portion 30 extending generally perpendicularly from the sidewall 24 and a vertical portion 32 extending generally perpendicularly from the horizontal portion 30. The free edge 26 defines a tray opening 36.

The tray 22 can be made of any suitable material, however, it is preferred that the tray 22 is made of plastic, and most preferably crystallized polyethylene terephlalate ("C-PETE") although other plastics, such as amoraphous polyethylene terephlalate ("A-PETE") or polypropylene can be used.

The food package 20 further consists of a sleeve 40 surrounding the tray 22. The sleeve 40 can be made of any suitable material, but is preferably made of paperboard. The sleeve 40 includes a front panel 42 having a display surface 44 including graphics such as text 45 or designs and illustrations, the front panel 42 being generally parallel and adjacent to the tray opening 36. The sleeve 40 also includes a back panel 46 and two side panels 48 and 50. The sleeve 40 is similar in design to one disclosed in my co-pending patent application, U.S. patent application Ser. No. 08/819, 889 filed on Mar. 18, 1997, now U.S. Pat. No. 5,743,402 the disclosure of which is hereby incorporated by reference herein. Another feature of the invention, which is also disclosed in the above-mentioned co-pending patent application, is a transparent plastic film 52 which covers the tray opening 36. As shown in FIGS. 1–9, the front panel 42 of the sleeve 40 does not completely cover the tray opening 36 but instead defines openings 54 and 56 through-which a consumer can view the food (not shown) in the food package 20.

The side panels 48 and 50 include tear strips 58 and 60 (FIGS. 7 and 8) to permit removal of the side panels 48 and 50 and back panel 46 from the tray 22. The front panel 42 can be removed by any known method, such as providing score lines and a thumb hole, as shown in U.S. Pat. No. 5,492,703, the disclosure of which is incorporated herein by reference.

It will be appreciated that the invention is not limited to the embodiment shown in FIGS. 1–9. For example, the transparent plastic film 52 does not have to be used, and, in that case, the front panel of the sleeve will completely cover the tray opening, as is shown in FIGS. 1–9 of my co-pending U.S. patent application Ser. No. 08/819,889.

Referring particularly to FIGS. 1, 2, 5, 6 and 9, the rigid leg member 80 of the invention will be discussed. The rigid leg member 80 extends from the back panel 46 and includes a bottom edge 82 that is adapted to rest on a support surface 84 (FIG. 2) in order to position the front panel 42 substantially perpendicularly to the support surface 84. In this way, the front panel 42 can be advantageously displayed to potential consumers for maximum effect. In addition, because the sleeve 40 has a full back panel 46, textual information such as cooking instructions 86 and nutritional information 88 shown in FIGS. 2 and 4 can be placed thereon, and not on the front panel 42. In this way, the front panel 42 can contain more graphic and text items that "sell" the product, as opposed to required textual information which may detract from the overall "look" of the package.

The rigid leg member 80 can be integral with the back panel 46 as shown in FIGS. 1–9 or can be a separate member. If integral, the sleeve 40 can be formed from one blank, with a portion, such as outside surface 48*a* of portion 48*b* of the side panel 48, being attached (as by, for example, adhesives) to the back panel 46 as shown in FIGS. 1–9. As can be seen in FIGS. 1–9, the rigid leg member 80 is co-planar with the rigid leg member 80.

Figure 2:
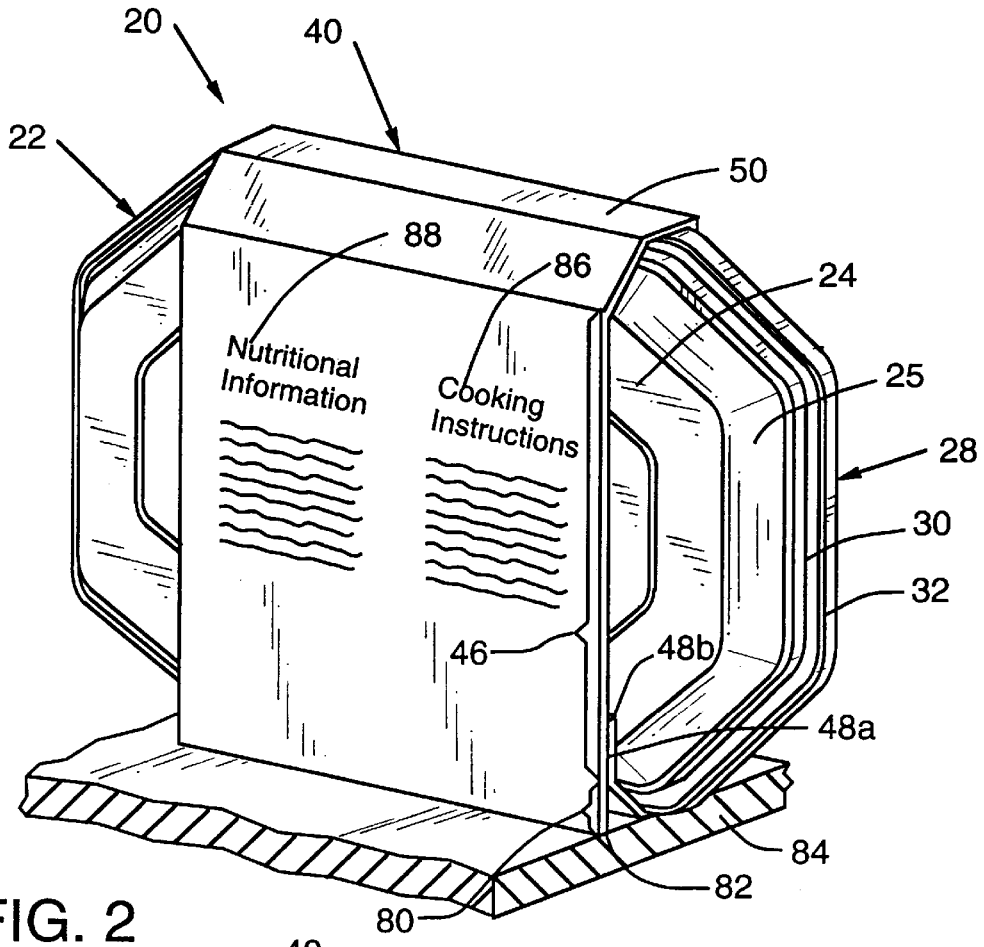
FIG. 2 is a perspective view showing the food package of FIG. 1 as assembled, and as would be "stood up" so that the display surface of the front panel is upright.
Figure 3:
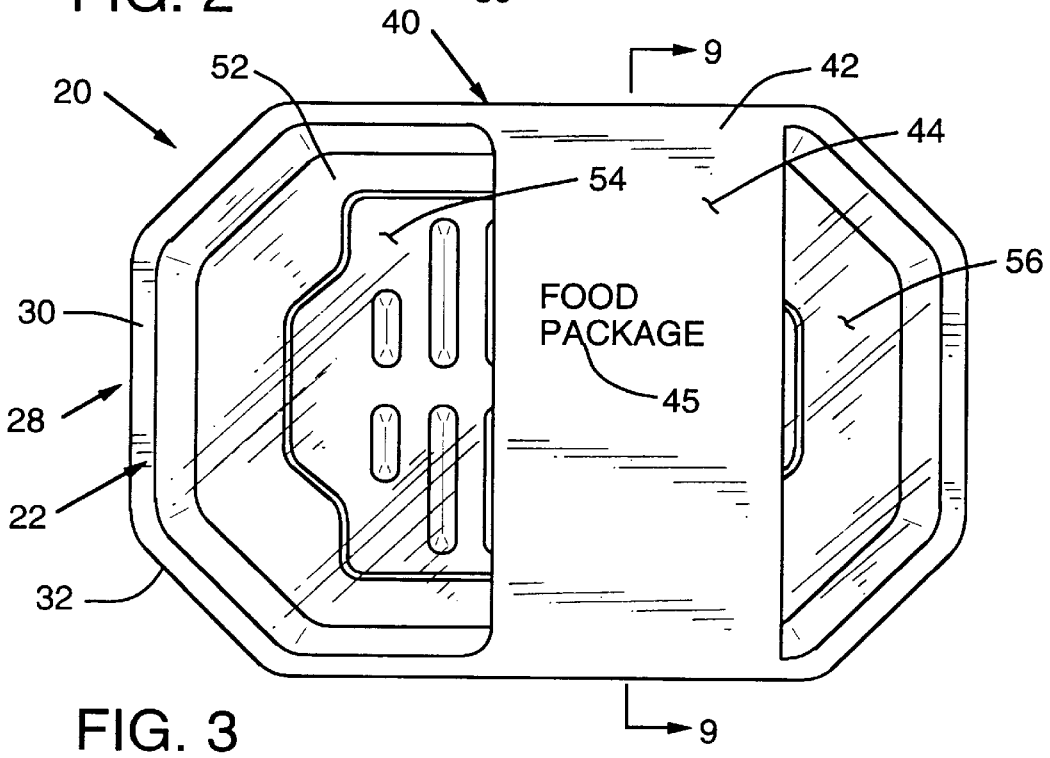
FIG. 3 is a top plan view of the food package of FIG. 2.
Figure 4:
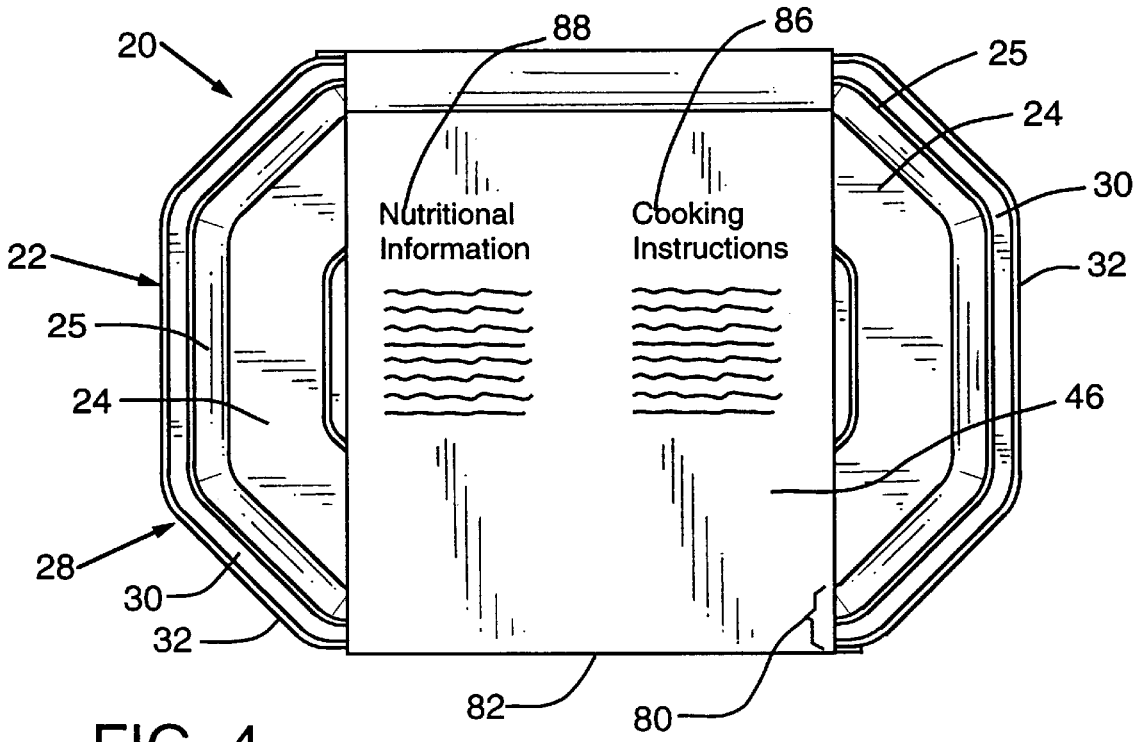
FIG. 4 is a bottom plan view of the food package of FIG. 2.
Figure 5:
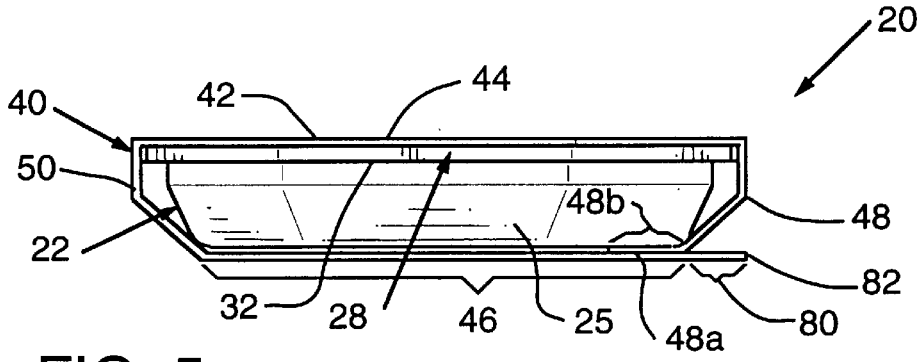
FIG. 5 is a left side elevational view of the food package of FIG. 2.
Figure 6:
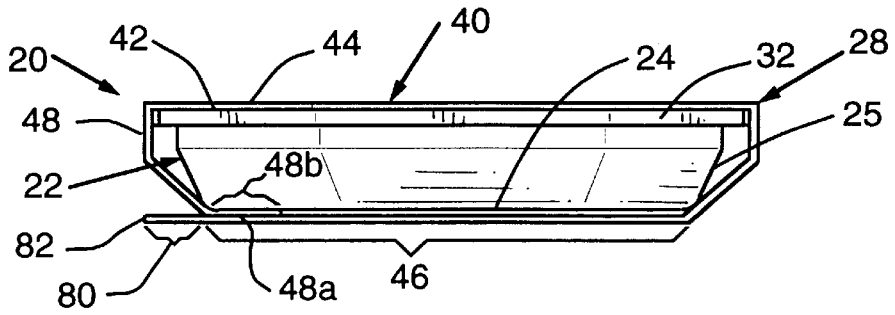
FIG. 6 is a right side elevational view of the food package of FIG. 2.
Figure 7:
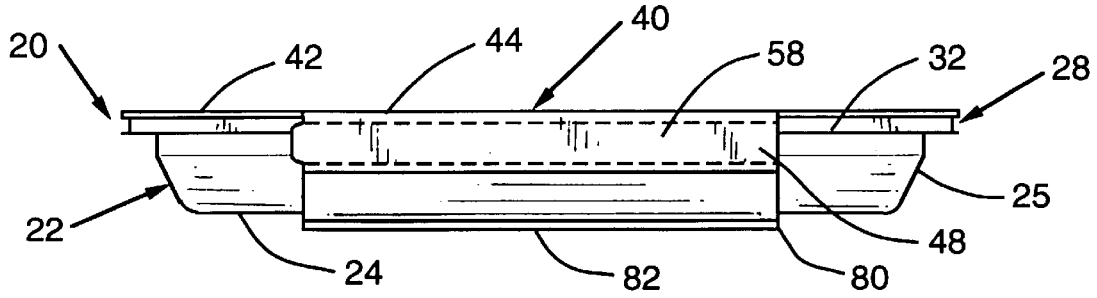
FIG. 7 is a front elevational view of the food package of FIG. 2.
Figure 8:
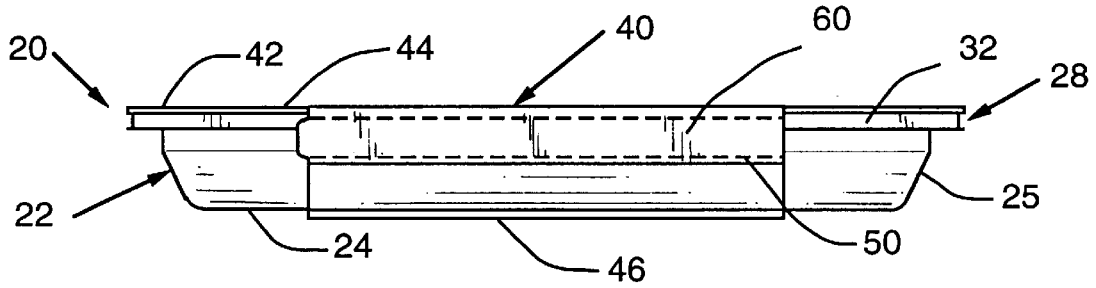
FIG. 8 is a back elevational view of the food package of FIG. 2.
Figure 9:
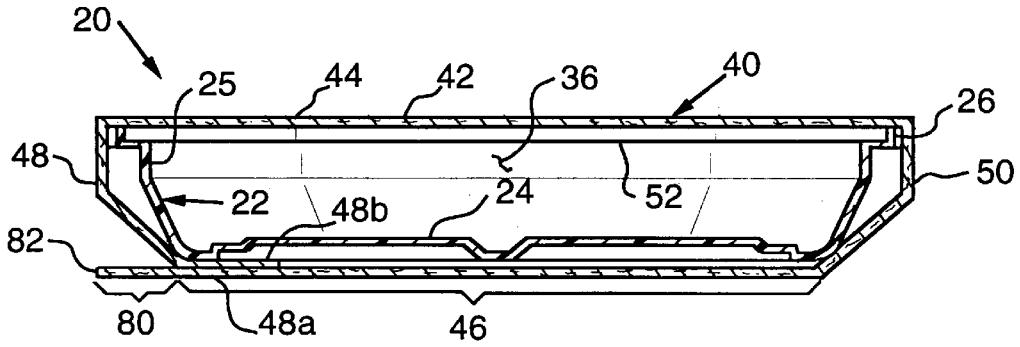
FIG. 9 is a cross-sectional view taken along line 9—9 of FIG. 3.
Figure 10:
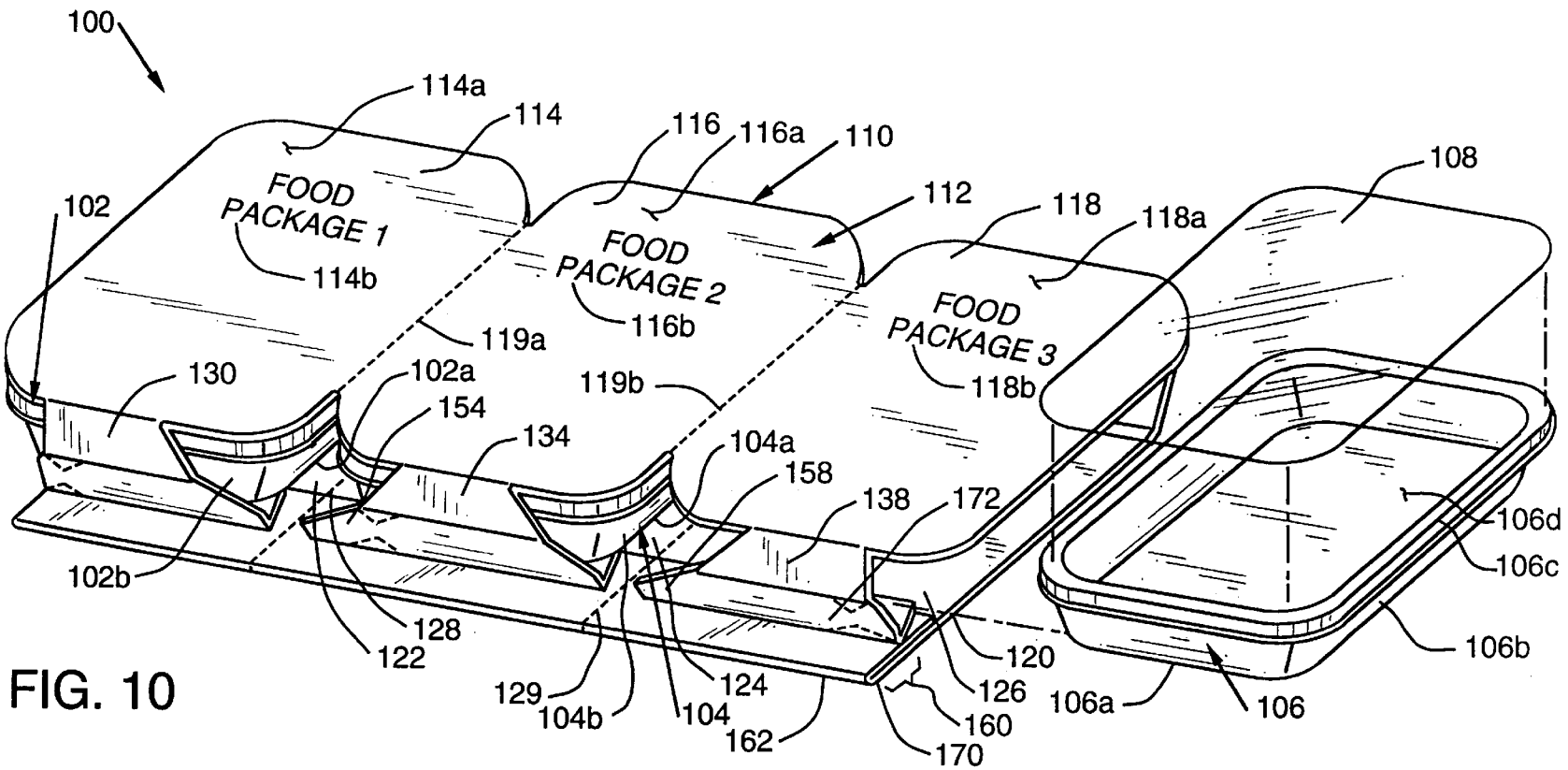
FIG. 10 is an exploded perspective of the multipack food package of the invention.

Referring to FIG. 2, the bottom edge 82 of the rigid leg member 80 is adapted to rest on the support surface 84. It will be appreciated that at least a portion of the side panel 48 will also rest on the support surface 84 to, along with rigid leg member 80, support the food package 20 in an upright position so that the front panel 42 is substantially perpendicular to the support surface and, further, so that display surface 44 of the front panel 42 can be seen by the consumer.

Referring now to FIGS. 10–18, a multipack food package in accordance with the invention will be described. The multipack food package 100 includes a plurality (here, three) of trays 102, 104, 106 each having a base 102*a*, 104*a*, 106*a* and a sidewall 102*b*, 104*b*, 106*b* extending from the base and terminating in a free edge 102*c*, 104*c*, 106*c* to define tray openings 102*d*, 104*d*, 106*d*. The trays 102, 104, 106 can be made of any suitable material, however, it is preferred that the trays 102, 104, 106 are made of plastic. Each tray 102, 104, 106, in this embodiment, includes a plastic film, such as plastic film 108 shown secured to free edge 106*c* of tray 106. It will be appreciated that this film is not necessary, as the invention also contemplates that the sleeve 110 (discussed below) can also cover the tray openings.

The multipack food package 100 further consists of a monolithic sleeve 110 including a front panel 112 having three sections 114, 116, 118 which are adjacent to and cover tray openings 102*d*, 104*d* and 106*d* of respective trays 102, 104, 106. The sections 114, 116 and 118 are separated by respective score lines 119*a* and 119*b* whose purpose will be discussed below. Each section 114, 116, 118 includes a display surface 114*a*, 116*a* and 118*a* which can contain graphics, such as respective textual matter 114*b*, 116*b* and 118*b*, as well as other designs and illustrations.

Figure 11:
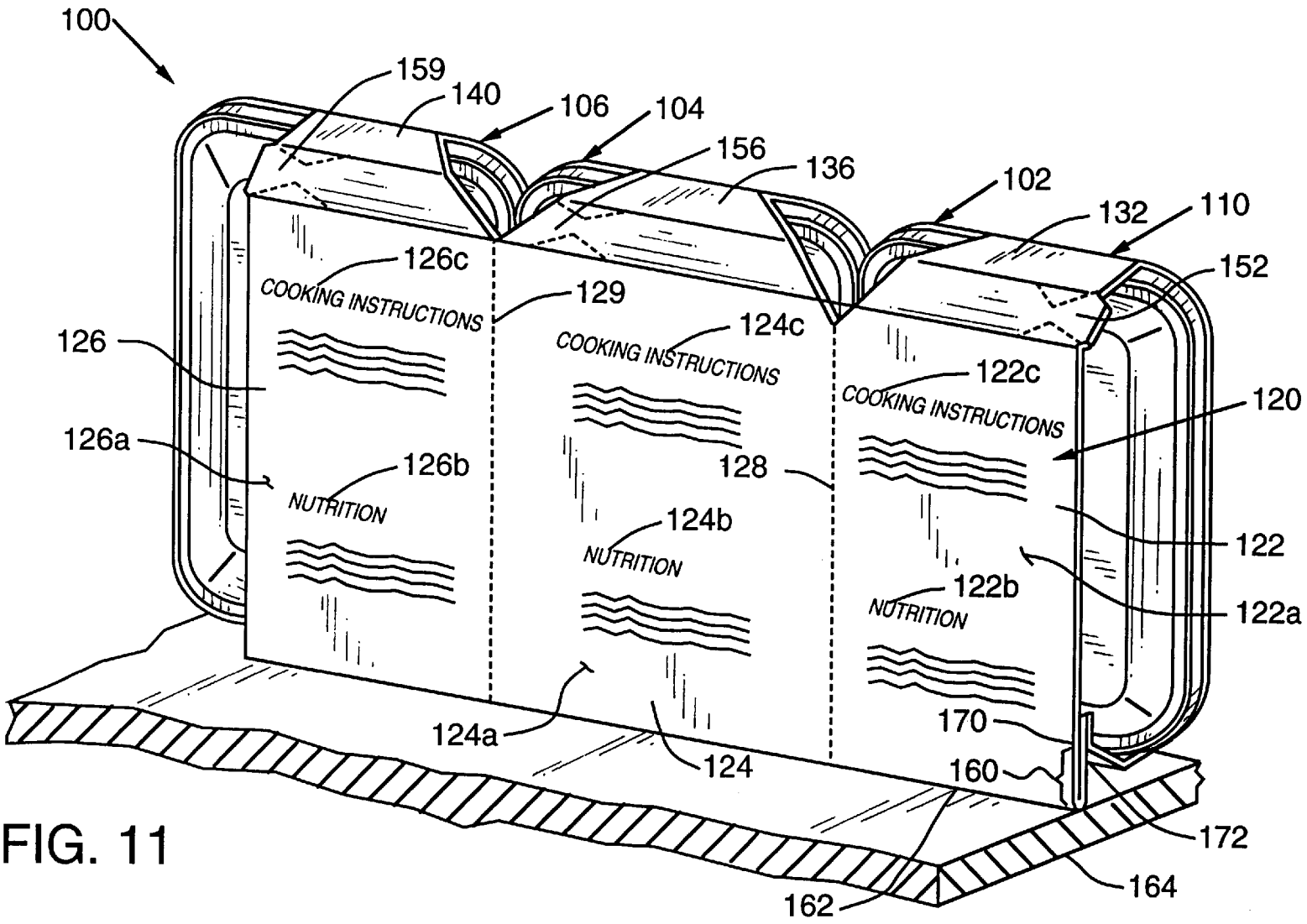
FIG. 11 is a perspective view showing the multipack food package of FIG. 10, as assembled, and as would be "stood up" so that the surface facing of the front panel is upright.
Figure 12:
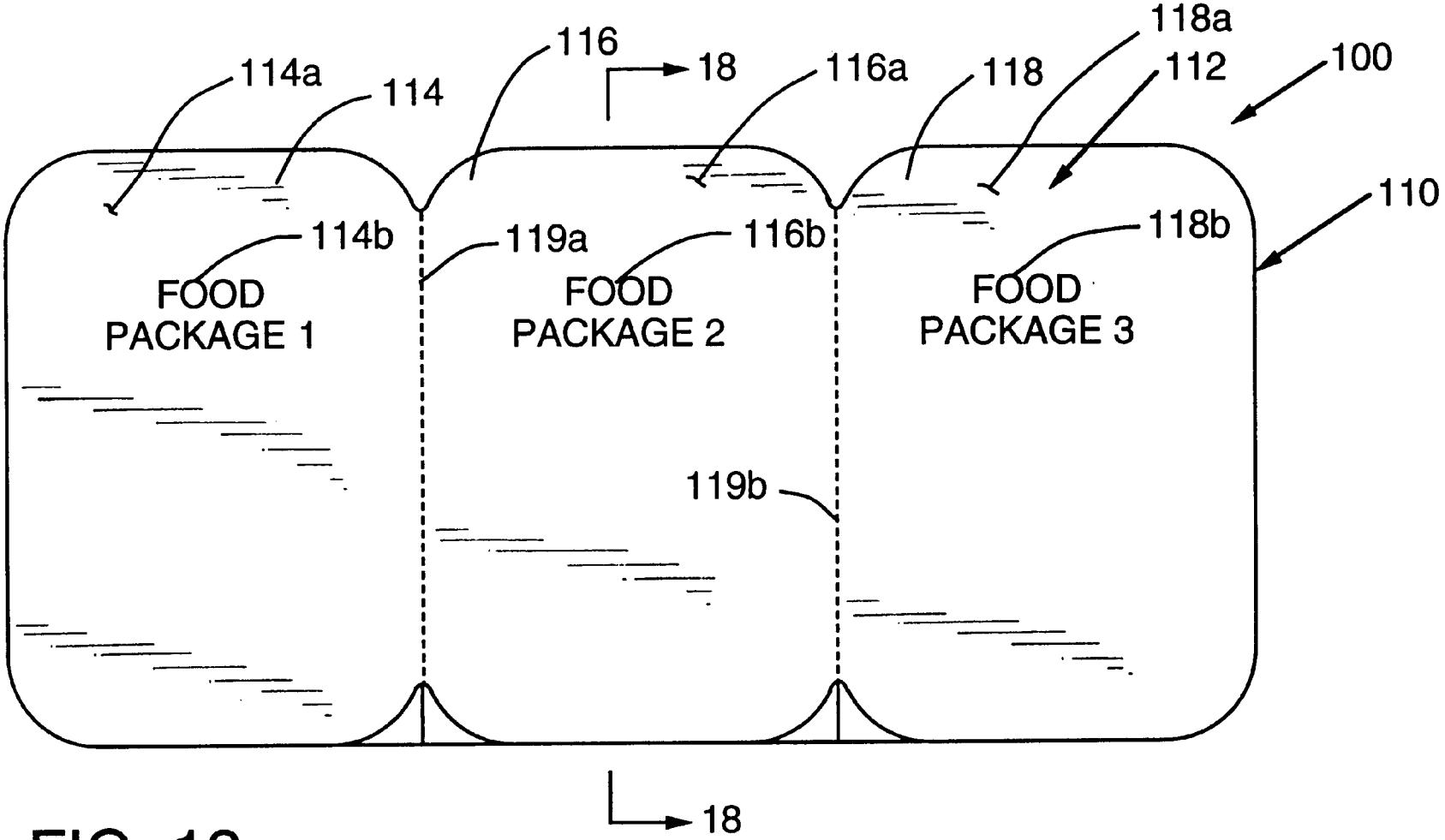
FIG. 12 is a top plan view of the multipack food package of FIG. 11.
Figure 13:
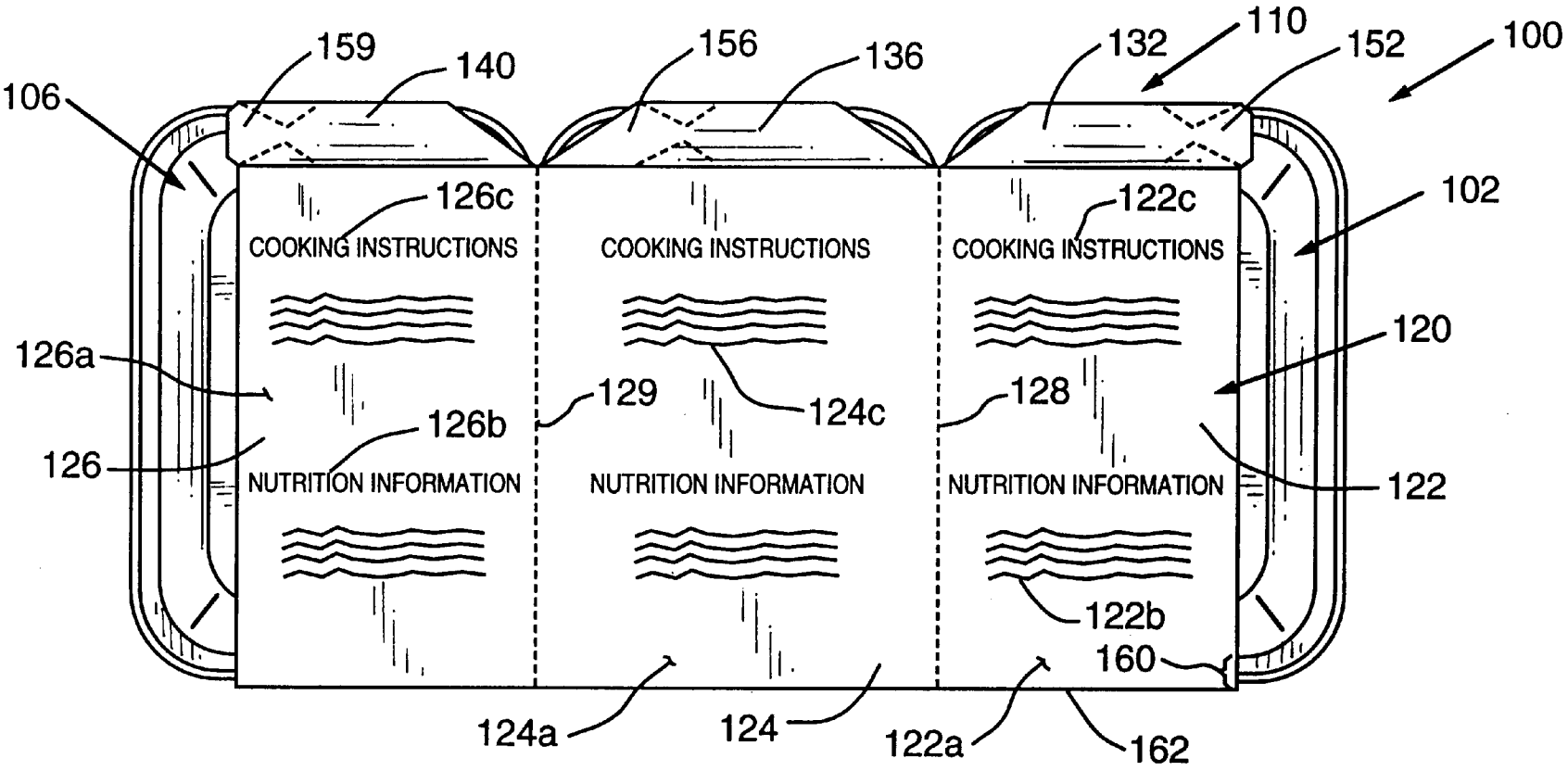
FIG. 13 is a bottom plan view of the multipack food package of FIG. 11.
Figure 14:
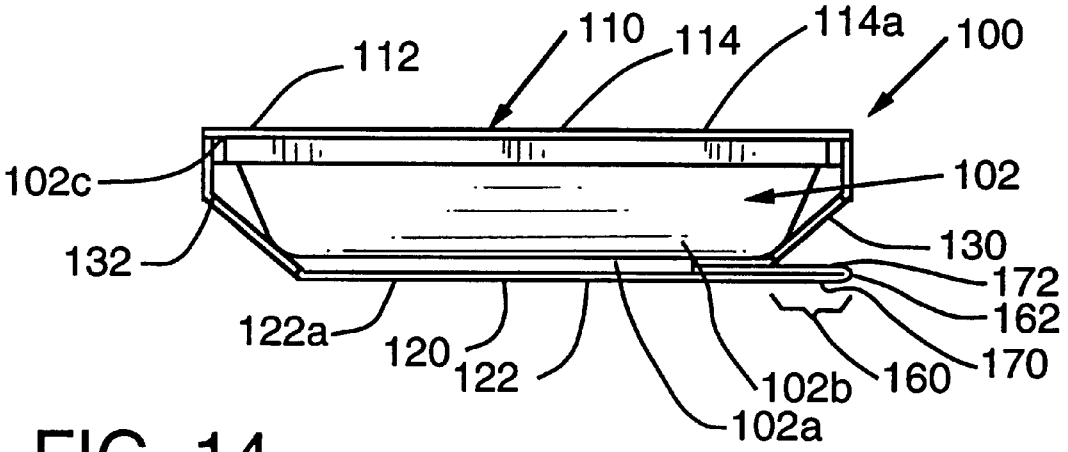
FIG. 14 is a left side elevational view of the multipack food package of FIG. 11.
Figure 15:
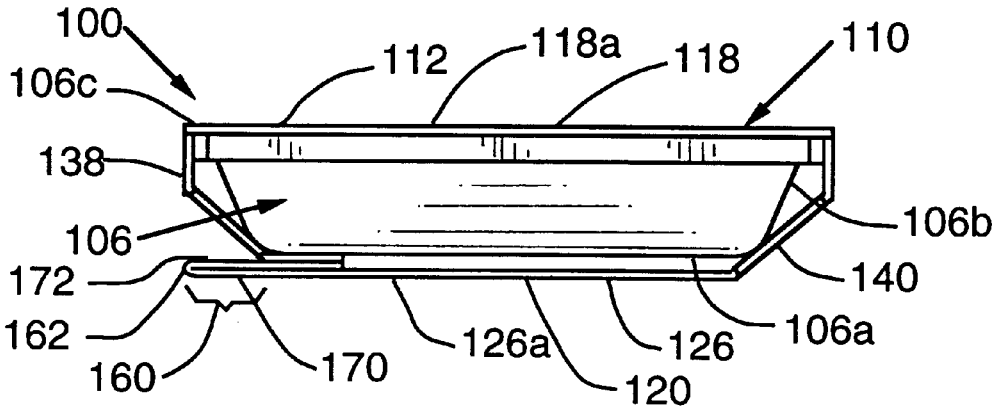
FIG. 15 is a right side elevational view of the multipack food package of FIG. 11.
Figure 16:
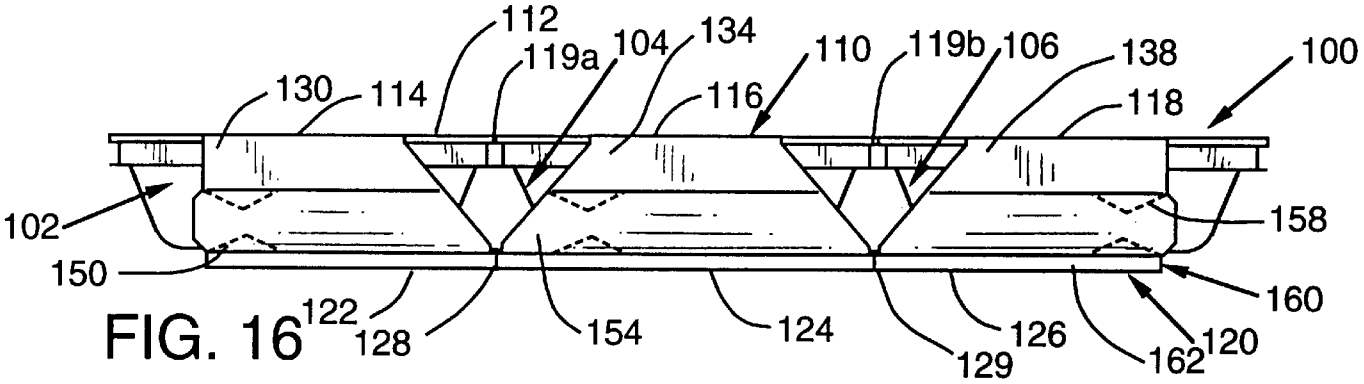
FIG. 16 is a front elevational view of the multipack food package of FIG. 11.
Figure 17:
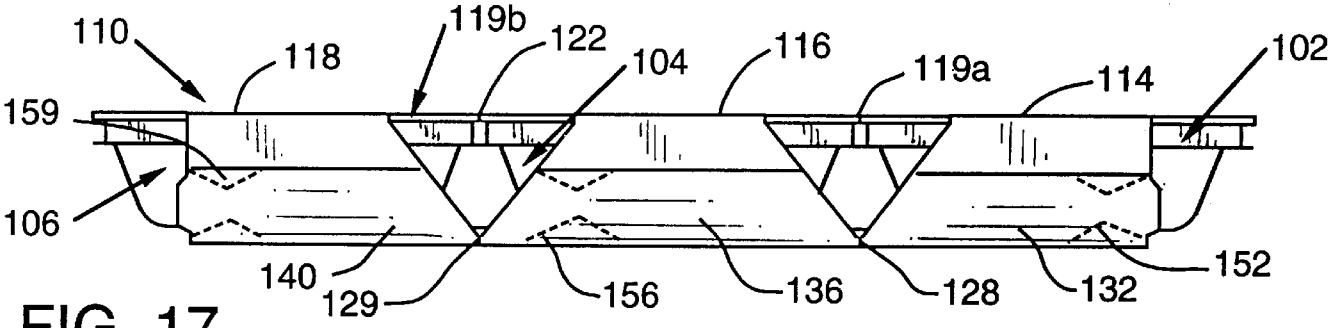
FIG. 17 is a back elevational view of the multipack food package of FIG. 11.
Figure 18:
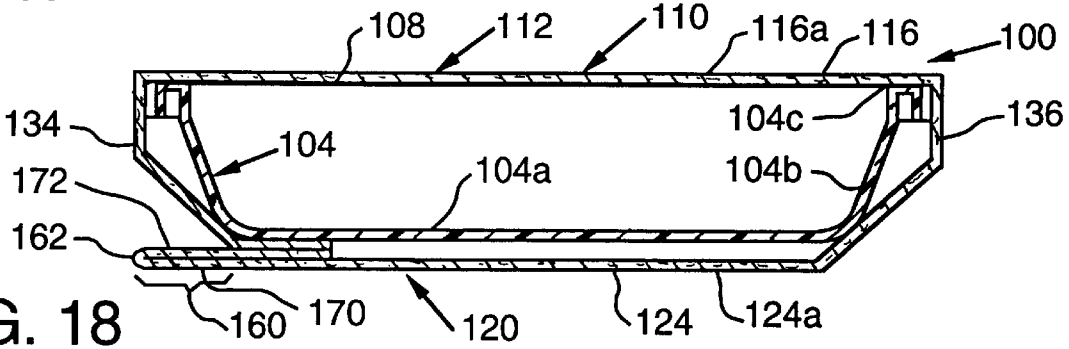
FIG. 18 is a cross-sectional view taken along line 18—18 of FIG. 12.

The sleeve 110 also consists of a back panel 120 also including three respective sections 122, 124 and 126 which are adjacent to respective bases 102*a*, 104*a* and 106*a*. Sections 122, 124, 126 each have display surfaces 122*a*, 124*a*, 126*a* for displaying textual matter such as nutritional information 122*b*, 124*b* and 126*b* as well as cooking instructions 122*c*, 124*c* and 126*c* (FIGS. 11 and 13). Sections 122, 124 and 126 are also separated by respective score lines 128 and 129, with score lines 128 and 129 being substantially parallel to score lines 119*a* and 119*b* so that a tray, such as tray 106, and the respective sleeve can be separated from the remainder of the food package. In this way, one tray can be used at a time, with the other two trays being stored. For example, if the food product in the trays 102, 104, 106 is baby food, one tray 106 could be used for one feeding with the other two trays being stored in the refrigerator for later feedings. Thus, the invention provides a convenient multipack while providing all the benefits of food package 20 shown in FIGS. 1–9, including the enhanced space for graphics and the "stand-up" capability as will be discussed further below.

Respective side panels 130, 132 for tray 102; side panels 134, 136 for tray 104; and side panels 138, 140 for tray 106 are provided. Tear strips 150, 152 for side panels 130, 132; tear strips 154, 156 for side panels 134, 136; and tear strips 158, 159 for side panels 138, 140 are also provided. The tear strips, as was discussed above with respect to the tear strips shown in FIGS. 1–9, allow the side panels and back panel sections to be removed from the respective front panel sections of the front sleeve. It will be appreciated, however, that monolithic side panels can be provided which have score lines separating the various sections.

Referring now to FIGS. 10, 11, 14, 15 and 18, the rigid leg member 160 of the multipack food package embodiment of the invention will be discussed. Similar to rigid leg member 80 of FIGS. 1–9, the rigid leg member 160 includes a bottom edge 162 that is adapted to rest on a support structure 164 (FIG. 11) in order to position the front panel 112 substantially perpendicularly to the support surface 164, so that the advantages mentioned above with regard to FIGS. 1–9 related to this feature can be obtained. With this design, however, the bottom edge of front panel 110 and/or a portion or all of the side panels can also rest on the support surface 164 along with bottom edge 162 of rigid leg member 160 in order to support the food package 100 in an upright manner as shown in FIG. 11.

The rigid leg member 160 is slightly different than rigid leg member 80 although it will be appreciated that either design disclosed can be used with either food package 20 or 100. Rigid leg member 160 shown in FIGS. 10–18 is a double-layered design to provide extra thickness for bottom edge 162, thus in turn providing more stability to the food package 100 when standing upright. The rigid leg member 160 includes an outside portion 170 and a folded-under inside portion 172. Portions 170 and 172 can be secured together by adhesives, with portion 172 then being secured, as by adhesives, to back panel 120. As with sleeve 40, sleeve 110 can be formed from a single blank, with the double layering created by merely folding inside portion 172 under outside portion 170.

It will be appreciated that a food package and a multipack food package have been disclosed which provide attractive, useful packaging that can stand upright so as to display attractive graphics to the consumer. The multipack food package also offers the advantage of allowing a consumer to use one or more of a plurality of trays, and store the remainder.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A multipack food package comprising:

a plurality of trays, said trays arranged in a side-by-side relationship and each having a base and a sidewall extending from said base and terminating in a free edge, said free edge defining a tray opening;

a sleeve surrounding said trays, said sleeve including at least one score line to facilitate separation of one or more trays from said multipack food package, said sleeve further including a front panel having a display surface, said front panel adjacent to all of said tray openings, and a back panel adjacent to all of said bases; and a rigid leg member extending from said back panel, said rigid leg member having a bottom edge that can rest on a support surface in order to position said front panel substantially perpendicularly to said support surface, whereby said display surface can-be better seen by potential consumers.

2. The multipack food package of claim 1, wherein said score lines are provided on said front panel, said back panel and said rigid leg member in order to separate a portion of said multipack food package from a remainder of said multipack food packages.

3. The multipack food package of claim 1, including a pair of opposed sidewalls extending between said front panel and said back panel.

4. The multipack food package of claim 1, wherein said sidewalls include separate sidewall portions disposed adjacent to each of said sidewalls of said plastic trays.

5. The multipack food package of claim 1, wherein said sleeve and said rigid leg member are formed from a single paperboard blank.

6. The multipack food package of claim 1, wherein said rigid leg member is integral with said back panel.

7. The multipack food package of claim 1, wherein said rigid leg member and said back panel are co-planar.

8. The multipack food package of claim 1, wherein said trays are made of plastic.

9. The multipack food package of claim 8 wherein said plastic is crystalline polyethylene terephthalate.

10. The multipack food package of claim 8, wherein said plastic is amorphous polyethylene terrephthalate.

11. The multipack food package of claim 8, wherein said plastic is polypropylene.

12. The multipack food package of claim 1, wherein said sleeve is made of paperboard.

13. The multipack food package of claim 12, wherein said rigid leg member is made of paperboard.

14. The multipack food package of claim 1, including a separate film secured to each of said plastic trays and covering each of said tray openings, said film being interposed between said plastic tray and said sleeve.

15. The multipack food package of claim 14, wherein said film is transparent; and said front panel defines openings so that a food product in said tray may be viewed before removal of said sleeve from said food package.

16. A multipack food package comprising:

a plurality of trays arranged in a side-by-side relationship; and a sleeve surrounding said trays, said sleeve including at least one score line to facilitate separation of one or more trays from said multipack food package.

17. The multipack food package of claim 16, wherein said trays are made of plastic.

18. The multipack food package of claim 17 wherein said plastic is crystalline polyethylene terephthalate.

19. The multipack food package of claim 17, wherein said plastic is amorphous polyethylene terrephthalate.

20. The multipack food package of claim 17, wherein said plastic is polypropylene.

21. The multipack food package of claim 16, wherein said sleeve is made of paperboard.

22. The multipack food package of claim 14, including a separate film secured to each of said plastic trays and covering a tray opening of each of said tray, said film being interposed between said plastic tray and said sleeve.

23. The multipack food package of claim 22, wherein said film is transparent; and said front panel defines openings so that a food product in said tray may be viewed before removal of said sleeve from said food package.

* * * * *